US005197290A

United States Patent [19]

Lee et al.

[11] Patent Number: 5,197,290

[45] Date of Patent: Mar. 30, 1993

[54] VARIABLE AREA COMBUSTOR AIR SWIRLER

[75] Inventors: Fei P. Lee, Novi; Theodore R. Koblish; Robert M. Halvorsen, both of Birmingham, all of Mich.

[73] Assignee: Fuel Systems Textron Inc., Zeeland, Mich.

[21] Appl. No.: 499,023

[22] Filed: Mar. 26, 1990

[51] Int. Cl.[5] ..... F02C 1/00

[52] U.S. Cl. ..... 60/748; 60/39.29; 137/855

[58] Field of Search ..... 60/722, 748, 39.23, 60/39.29; 137/855

[56] References Cited

U.S. PATENT DOCUMENTS

| | | | |
|---|---|---|---|
| 2,899,981 | 8/1959 | Binks | 137/855 |
| 3,030,773 | 4/1962 | Johnson | 60/748 |
| 4,638,636 | 1/1987 | Cohen | 60/748 |
| 4,807,433 | 2/1989 | Maclin et al. | 60/39.29 |
| 4,962,889 | 10/1990 | Halvorsen | 137/855 |

*Primary Examiner*—Richard A. Bertsch
*Assistant Examiner*—Michael I. Kocharov
*Attorney, Agent, or Firm*—Reising, Ethington, Barnard, Perry & Milton

[57] ABSTRACT

The gas turbine combustor air swirler includes a spring temper swirler member having a plurality of air control doors or vanes so cut therein about the longitudinal axis of the combustor inlet as to be integrally and resiliently pivotally connected to the swirler member. The air control doors are progressively canted open to provide predetermined air flow rate and air swirl angle to the combustor inlet in response to increases in air pressure differential thereacross resulting from progressive increases in fuel flow through the nozzle during various regimes of engine operation. The swirler is free of linkages and sliding or other contacting components that are susceptible to binding and other malfunctions in service in the engine.

21 Claims, 4 Drawing Sheets

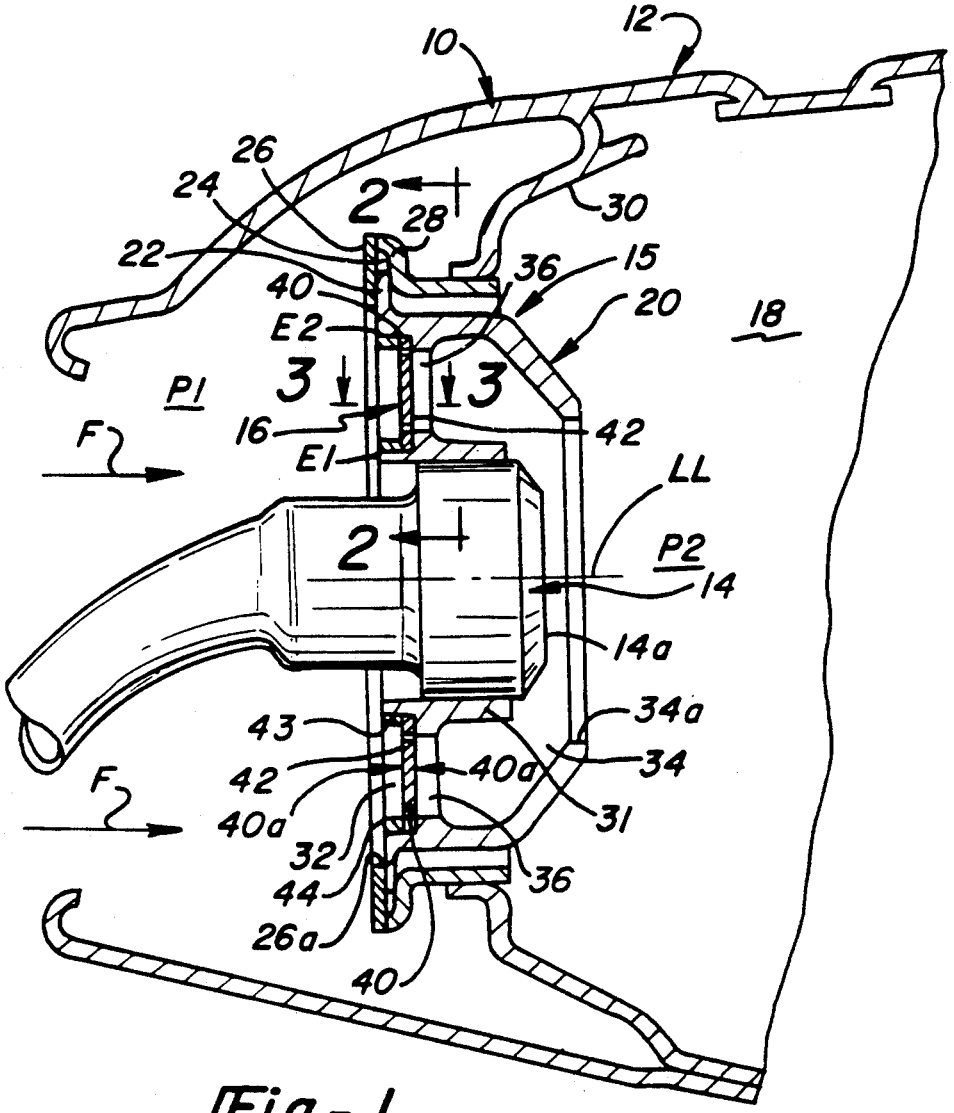
Fig - 1
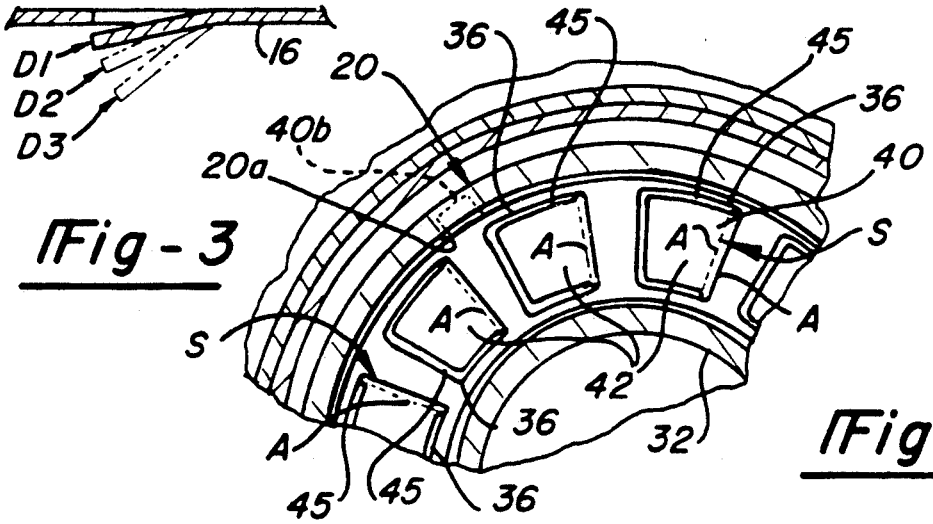
Fig - 3
Fig - 2

VARIABLE AREA COMBUSTOR AIR SWIRLER

FIELD OF THE INVENTION

The present invention relates to combustors for gas turbine engines and, more particularly, to a combustor having an air pressure responsive, variable geometry swirler for controlling flow rate and swirl angle of compressor discharge air to the combustor.

BACKGROUND OF THE INVENTION

U.S. Pat. Nos. 4,534,166; 4,542,622 and 4,606,190 describe a gas turbine engine combustor having an air pressure responsive, variable area/geometry swirler disposed about a fuel nozzle for controlling flow rate of compressor discharge air to the combustor to reduce objectionable emissions and improve combustor efficiency.

In U.S. Pat. No. 4,534,166, the swirler comprises a mechanical-type register plate throttle arrangement that controls airflow rate to the combustor and also provides different swirl angles for a take-off/cruise regime and an idle regime of engine operation. In particular, a higher swirl angle and airflow rate are provided by the register plate throttle for the idle regime than for the take-off/cruise regime of engine operation. In the "lightoff" regime, the register plate throttle prevents airflow therethrough to provide a high fuel-to-air ratio for engine ignition. Varying the quantity and the direction of discharge (i.e., swirl angle) of air from the swirler is accomplished by rotating a vane assembly relative to a stationary vaned plate using an actuable drive arm connected at one end to the rotatable vane assembly and at the other end through a spherical bearing to a unison ring whereby other swirlers associated with the combustor section of the engine can be actuated in unison.

In U.S. Pat. Nos. 4,606,190 and 4,542,622, a self-actuating nozzle guide vane (swirler) device operates to increase airflow to the combustor during higher power regimes (above idle) of engine operation in response to increases in pressure drop across the combustor during such engine operation. The nozzle guide vane device employs a continuously operating primary swirler and a secondary swirler that operates only when the pressure drop across the front (upstream end) of the combustor reaches a predetermined level. The secondary swirler comprises an annular array of secondary guide vanes carried on a spring biased slidable support member that is actuated (to slide) when the pressure differential across the slidable member reaches a predetermined value. The support member slides from a closed position to a stop-limited, full open position to admit additional air to the combustor when the predetermined value is reached.

Alternately, in these patents, the secondary swirler comprises a plurality of bimetal springs fastened on an apertured member of the combustor. The bimetal springs are openable to a full open position to admit secondary air to the secondary guide vanes upon reaching a high temperature threshold level indicative of higher engine power regimes above idle.

It is an object of the invention to provide a gas turbine engine combustor with a self-actuating, variable area/geometry swirler which can progressively vary airflow rate to the combustor inlet in response to increases in air pressure differential thereacross resulting from progressive increases in fuel flow through an associated fuel nozzle.

It is another object of the invention to provide a gas turbine engine combustor with a self-actuating, variable area/geometry swirler wherein the direction of discharge, i.e., the swirl angle, of air admitted to the combustor inlet is varied as a result of progressive variations in airflow rate.

It is still another object of the invention to provide such a combustor swirler which is free of mechanical linkages, free of relative sliding or other contact between components and thus an improvement over existing complex mechanical variable area/geometry swirlers.

SUMMARY OF THE INVENTION

The present invention contemplates an improved self-actuating, variable area/geometry air swirler cooperatively disposed relative to an upstream combustor inlet. The air swirler includes a swirler member having a plurality of air control doors (or vanes) so formed therein as to be integrally and resiliently pivotally connected therewith such that the doors are progressively canted relative to the swirler member to provide a predetermined air flow rate and air swirl angle to the combustor inlet in response to variations in air pressure differential upstream and downstream of the swirler (resulting from progressive variations in fuel flow through a fuel nozzle cooperatively disposed relative to the combustor inlet).

The air control doors are progressively canted in an open direction or closed direction relative to an initial closed position in response to respective progressive increases or decreases in the air pressure differential upstream and downstream thereof during normal engine operation among lightoff (ignition), idle and take-off/cruise regimes. As a result of the progressive canting of the air control doors, the swirler provides a greater swirl angle under lightoff (ignition) conditions than under the take-off/cruise regime to improve combustor performance and engine ignition.

Preferably, the air control doors are each so cut in a swirler member which is made of thin, spring temper material (preferably a spring temper metal), as to include a side integrally and resiliently pivotally connected to the swirler member to define a door hinge axis. The air control doors typically are cut in the swirler member so as to be spaced apart around the longitudinal axis of the combustor inlet.

The self-actuating, variable area/geometry swirler of the invention is adaptable to axial air inflow and radial air inflow combustor inlet systems in existence today. The swirler is also useful in combination with various types of fuel nozzles such as airblast, pressure atomizing and hybrid airblast/pressure atomizing nozzles.

The aforementioned objects and advantages of the invention will become more readily apparent from the detailed description and drawings which follow.

BRIEF DESCRIPTION OF THE DRAWINGS

FIG. 1 is a cross-sectional view of an upstream portion of a gas turbine engine combustor with a fuel nozzle and variable area air swirler in accordance with one embodiment of the invention.

FIG. 2 is a partial cross-sectional view taken along arrows 2—2 of FIG. 1.

FIG. 3 is a partial cross-sectional view through an air control door showing various positions of the air control door.

DETAILED DESCRIPTION OF THE INVENTION

Figure 4:
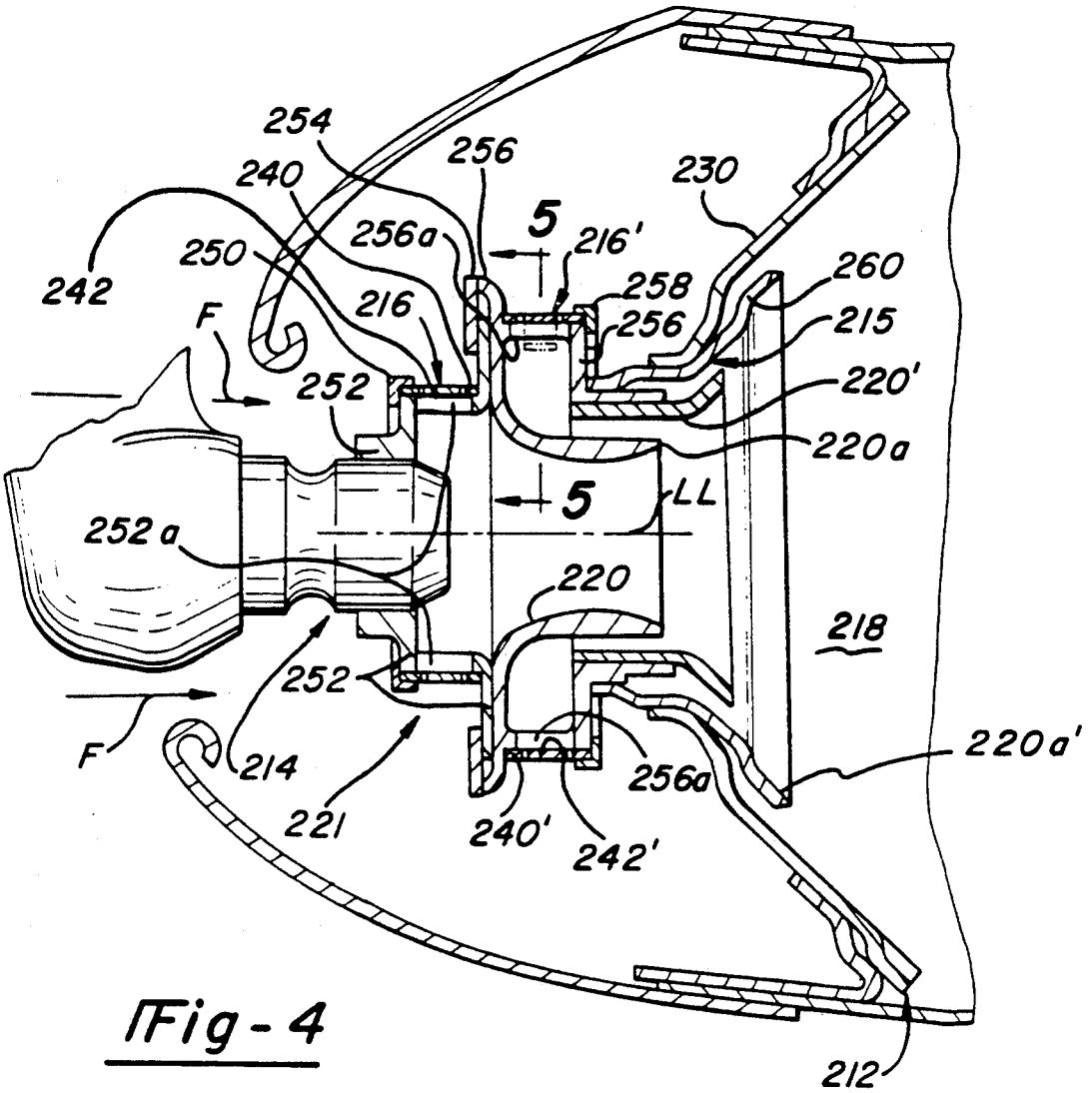
FIG. 4 is a cross-sectional view of an upstream portion of a gas turbine engine combustor with a fuel nozzle and variable area air swirler in accordance with another embodiment of the invention.

Referring to FIG. 1, there is shown the upstream portion 10 of a combustor 12 of a gas turbine engine. The upstream portion 10 has a fuel nozzle 14 and a self-actuating, variable area/geometry air swirler 16 cooperatively disposed relative to combustor inlet 15 to supply a mixture of fuel and air to the combustion chamber 18 of the combustor 12 for combustion therein. Air is supplied to the swirler 16 from an upstream compressor (not shown) of the gas turbine engine in known manner. That is, the air flow F upstream of the swirler 16 comprises compressor discharge air.

The fuel for combustion is supplied to the chamber 18 by the fuel nozzle 14. In particular, the fuel nozzle 14 discharges a fuel stream from nozzle discharge face 14*a* for mixing with compressor discharge air supplied by the swirler 16. As shown best in FIG. 1, the fuel nozzle 14 is generally concentric with the longitudinal axis LL of the combustor inlet 15. As will be explained in further detail hereinbelow, the swirler 16 imparts a swirling motion to the air discharging therefrom to aid in mixing with and atomization of the fuel for promoting combustion in chamber 18.

Figure 6:
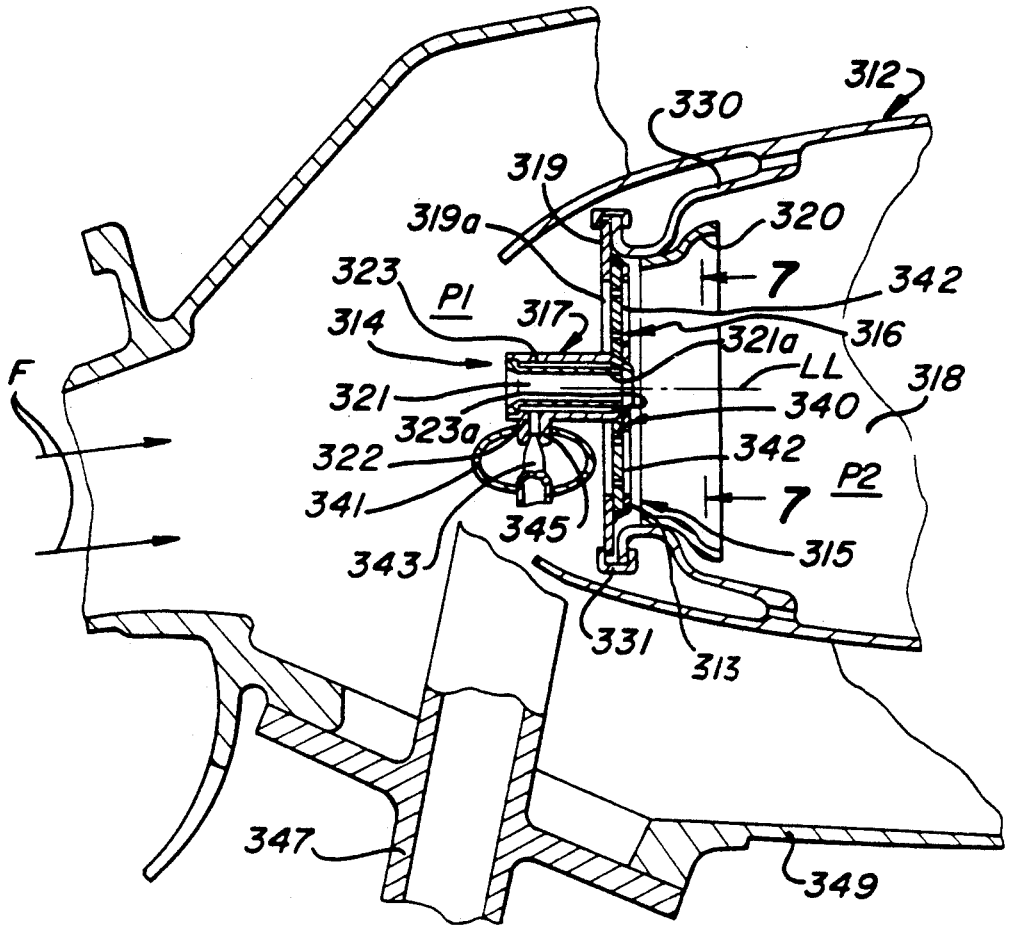
FIG. 6 is a cross-sectional view of an upstream portion of a gas turbine engine combustor with a fuel nozzle and variable area air swirler in accordance with still another embodiment of the invention.

The fuel nozzle 14 can be of various types such as an airblast fuel nozzle as described in FIG. 2 of the Helmrich U.S. Pat. No. 3,684,186, a pressure atomizing fuel nozzle as described in Bradley et al U.S. Pat. No. 4,491,272 or a hybrid airblast/pressure atomizing nozzle a shown in FIG. 1 of the aforementioned Helmrich patent. A particular fuel pressure responsive airblast fuel injector for use in practicing the invention is shown in FIG. 6 and will be described in greater detail hereinbelow.

In accordance with the present invention, the self-actuating, variable area/geometry swirler 16 provides a predetermined airflow rate and air swirl angle (direction of air discharge from the swirler 16) to the combustor inlet 15 in response to increases or decreases in air pressure differential upstream and downstream of the swirler (i.e., P1 versus P2) resulting from progressive increases or decreases in fuel flow through the nozzle 14 that correspond with the various operating regimes of the gas turbine engine (e.g., "lightoff" (ignition), idle and take-off/cruise regimes that require different fuel flow rates, air flow rates and air swirl angles for optimum combustor efficiency).

The swirler 16 is disposed on an annular air swirler shroud 20 that is supported in the . combustor inlet 15 in a manner as to accommodate various thermal expansion movements of components during engine operation. In particular, the air swirler shroud 20 includes a outer peripheral lip 22 received in slot 24 between upstream and downstream members 26,28 that are fastened to the upstream wall 30 of the combustor 12. The upstream member 26 includes central opening 26*a* to receive the fuel nozzle 14. The shroud 20 includes a tubular, cylindrical central hub 31 for receiving the fuel nozzle 14 therein as shown.

The air shroud 20 includes an annular upstream recess 32 communicating to a downstream swirl chamber 34 via a plurality of circumferentially spaced apart windows or apertures 36. The swirl chamber 34 includes a downstream annular air discharge lip 34*a*.

Referring to FIGS. 1 and 2, the swirler 16 comprises one or more thin, flat annular, spring temper swirler members or plates 40 (one shown) received in the recess 32. The swirler member 40 is located or indexed circumferentially relative to the shroud 20 by an integral, anti-rotation index tab 40*b* on member 40 received in a slot in the shroud 20 and is held in the indexed position by inner and outer fixturing rings 43,44 which are fastened to the air swirler shroud 20 by electron beam welds at E1,E2.

The swirler member 16 is shown concentrically disposed about the fuel nozzle 14 (i.e., the longitudinal axis of the annular swirler me:nber 16 is generally parallel or coaxial with inlet axis LL). The swirler member 40 includes axial ends or sides 40*a* that are transverse, more specifically normal, to inlet axis LL. The swirler member 40 preferably comprises a thin spring temper metal sheet, such as known, commercially available INCO 750, AMS 5583, AMS 5598 alloys, having a thickness from about 0.001 inch to about 0.010 inch. The swirler member 40 may alternately comprise multiple sheets stacked together.

Figure 8B:
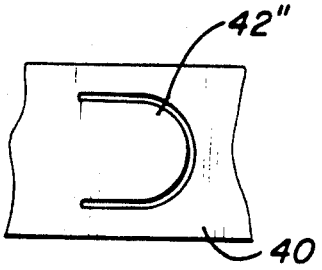
FIGS. 8A, 8B, 8C are partial elevational views of air swirler member showing different configurations of the air control door.
Figure 8A:
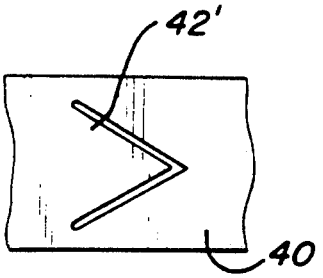
Figure 8C:
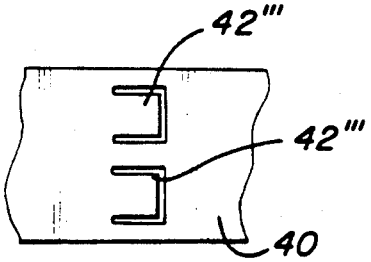
Figure 9:
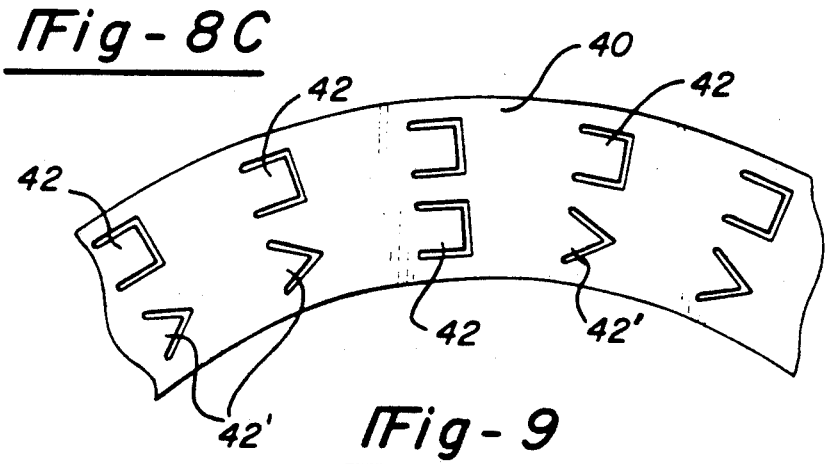
FIG. 9 is a partial elevational view of the swirler member of another embodiment showing two rows of air control doors with the doors having different configurations.
Figure 10:
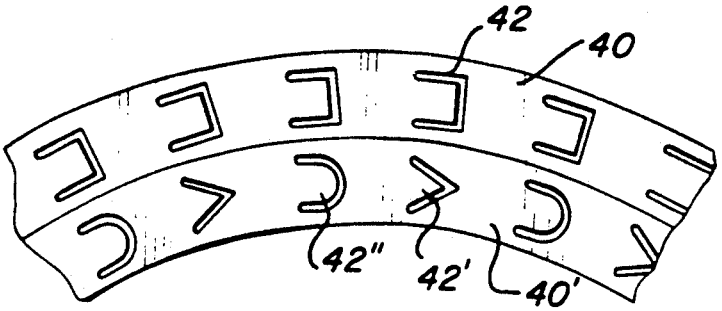
FIG. 10 is a partial elevational view of juxtaposed first and second swirler members in still another embodiment having different configurations of air control doors.

Each of a plurality of air control doors 42 (or vanes) is so formed in the swirler member 40 as to be integrally and resiliently pivotally connected thereto by a door or vane hinge axis A. Preferably, each door 42 is defined by a narrow (e.g., 0.007 inch in width—shown exaggerated for clarity) incision 45 cut into the swirler member 40 by suitable means. Preferably, the incision 45 defining each door 42 in the swirler member 40 is made by conventional photoetching processes, although the invention is not so limited. As shown best in FIG. 2, in accordance with one embodiment of the invention the air control doors 42 are parallelogram in configuration or profile with one side S of the parallelogram shape forming the hinge axis A where it is integrally and resiliently pivotally connected to the swirler member 40. However, the air control doors 42 may have other shapes, for example, as shown in FIGS. 8A,B,C for doors 42,42',42" which are, provided to illustrate, but not limit, the configurations of air control doors which may be useful in the invention. The invention envisions combining different configurations of air control doors 42,42',42" on the same swirler member 40 as shown in FIG. 9 or on individual juxtaposed swirler members 40,40' circumferentially juxtaposed together as shown in FIG. 10.

The air control doors 42 are cut into the swirler member 40 in circumferentially spaced apart relation about the longitudinal axis LL of the combustor inlet 15. The hinge axes A of the air control doors 42 are transverse to the inlet axis LL. Each door 42 is in registry with a respective window or aperture 36, FIG. 2, in the air swirler shroud 20 to permit door opening/closing and air flow to the swirl chamber 34.

For the axial inflow swirler shown in FIGS. 1--, the air control doors 42 are progressively canted open (or closed) in an axial direction relative to the support member 40 (see phantom showing of open positions of the air control door 42 in FIG. 3) for providing predetermined air flow rate and direction of air discharge solely in response to progressive increases (or decreases) in the air pressure differential (P1 vs. P2) upstream and downstream of the swirler 16 (which is similar to the air pressure upstream and downstream of the combustor).

As will be apparent, the degree of spring temper and thickness of the swirler member 40 as well as the size and shape of doors 42 and sides S thereof (defining the hinge axes A) are controlled to provide a desired predetermined canting action in dependence upon the pressure drop (P1 vs. P2) across the swirler 16 due to progressive increases (or decreases) in fuel flow through the nozzle 14. The air flow rate as well as air swirl angle can thereby be controlled in dependence on the fuel flow through the nozzle 14.

In FIG. 1, the air control doors 42 are shown in their closed positions generally coplanar with the flat swirler member or plate 40 when the gas turbine engine is not operating; i.e., the air control doors 42 are in the closed position when P1 and P2 are generally equal (little or no air pressure differential across the swirler 40). During the engine "lightoff" (engine ignition regime of operation when the compressor is initially "windmilling", the air control doors 42 will be canted open slightly (see solid line position D1, FIG. 3) to impart a relatively high swirl angle to the air admitted through the doors 42. As is apparent from FIG. 2, the air discharge direction is tangential to the inner cylindrical surface 20*a* of the air swirler shroud 20. This relatively high swirl angle imparts a relatively high degree of swirl to the air admitted to the air swirler shroud 20 and then to the combustor chamber 18 via air discharge lip 34*a* to facilitate engine ignition when compressor discharge air pressure is relatively low. As the engine is placed in the idle regime of operation (by increasing fuel flow through the nozzle 14), the air pressure differential (P1 vs. P2) increases accordingly and effects further progressive canting of the doors 42 to a more open position (see phantom position D2, FIG. 3) to provide a greater air flow rate and a lesser air swirl angle (lesser tangential component in the air discharge direction) to the air entering the combustor chamber 18 from the air swirler shroud 20.

As the engine is placed in the take-off or cruise regime of operation (by further increasing fuel flow through the nozzle 14), the air pressure differential (P1 vs. P2) increases accordingly and effects additional progressive canting of the doors 42 to a more open position (see phantom position D3) to provide a still higher air flow rate and still lesser air swirl angle then present during the idle regime of engine operation.

Although only three door open positions D1,D2,D3 are shown in FIG. 3, it should be understood that the air control doors 42 typically are progressively canted in the open direction as the air pressure differential (P1 vs. P2) is increased. Moreover, as the air pressure differential is progressively decreased, the air control doors 42 are progressively canted in a closing direction (toward the swirler member 40) by virtue of the integral and resiliently pivotable connection of sides S of the doors 42 to the swirler member 40. Thus, the air control doors canted in an open direction in progressive manner by action of progressively increasing air pressure differential thereacross and are canted in a closed direction (by the resilient connection of sides S thereof to the swirler member 40) as the air pressure differential (P1 vs. P2) decreases. This action is effective to provide a predetermined variable air flow rate and variable air swirl angle in response to changes in fuel flow through the nozzle 14 over the various regimes of operation of the engine.

Figure 5:
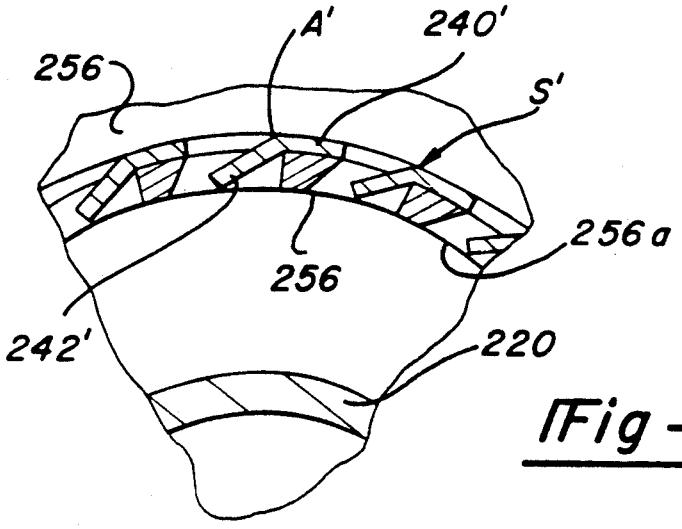
FIG. 5 is a partial cross-sectional view taken along arrows 5—5 of FIG. 4.

Referring to FIGS. 4 and 5, another embodiment of the invention provides a pair of radial inflow air swirlers 216,216' cooperatively disposed relatively to the upstream inlet 215 of the gas turbine engine combustor 212 for providing a predetermined air flow rate and air swirl angle for mixing with fuel discharged from the fuel nozzle 214.

The air swirlers 216,216' are disposed on an air swirler shroud assembly 221 with the upstream swirler 216 disposed radially (or transversely) inwardly of the downstream swirler 216'. The air swirlers 216,216' are similar and include respective air control doors 242,242' cut or otherwise formed in the respective cylindrical tubular spring temper swirler members 240,240' in the manner described hereinabove for the first embodiment of the invention so as to be integrally and resiliently connected to the respective swirler member 240,240' by a side S' providing a door hinge axis A'. The hinge axes A' of the air control doors 242,242' are generally parallel to the inlet axis LL. The air control doors 242 are parallelogram in shape (or other shape) and are spaced apart about the circumference of the respective swirler members 240,240' and inlet axis LL.

The air control doors 242,242' function in the same manner described above for the first embodiment to provide a predetermined air flow rate and air swirl angle to air flow F admitted to the shroud assembly 221 and discharged into the combustor chamber 218 in response to increases (or decreases) in the air pressure differential across the swirlers 216,216' resulting from progressive increases (or decreases) in fuel flow through the nozzle 214 during operations of the engine among the regimes mentioned hereinabove. In FIGS. 3 and 4, the air control doors 242,242' are progressively canted open in a generally radial direction (i.e., transverse to the longitudinal axis LL of the inlet 215), e.g., as shown in FIG. 4, to provide the desired air flow rate and air swirl angle to a respective inner, upstream air swirler shroud 220 (formed on assembly member 256) and outer, downstream air swirler shroud 220' (attached to assembly member 256) for discharge to the combustor chamber 218 past respective air discharge lips 220*a*,220*a*' for mixing with the fuel from the fuel nozzle 214. The shroud assembly 221 is supported on the upstream combustor wall 230 by a mounting assembly comprising members 250,252,254,256, 258 and 260 adapted to accommodate thermal expansion movements of the various components during engine operation. Members 252 and 256 include a plurality of circumferentially spaced apart openings 252*a* and 256*a* in registry with the circumferentially spaced apart air control doors 242,242' to accommodate opening of the doors 242,242' and air flow therefrom.

Figure 7:
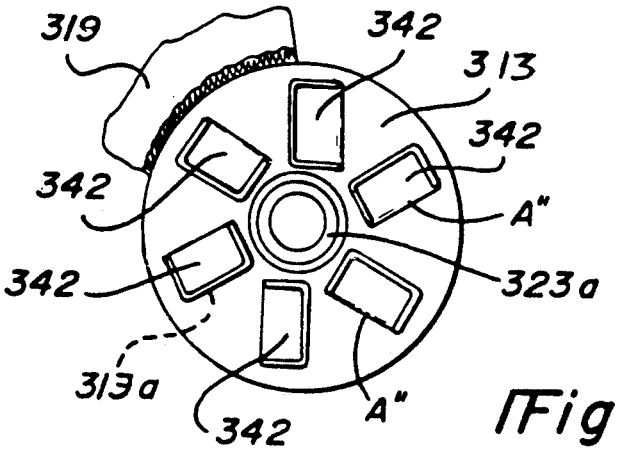
FIG. 7 is an elevational view taken along arrows 7—7 of FIG. 6.

Referring to FIGS. 6 and 7, still another embodiment of the invention is shown for providing predetermined air flow and air swirl angle to the chamber 318 of the gas turbine engine combustor 312 using an axial inflow self-actuating, variable area swirler 316 in combination with fuel nozzle 314. In particular, the swirler 316 is generally similar to that shown in FIGS. 1-2 in comprising an annular, flat swirler member 340 having a plurality of air control doors (or vanes) 342 integrally and resiliently pivotally connected thereto by respective hinge axes A" that are oriented transverse to the longitudinal axis LL of the combustor inlet 315. The swirler 316 and a downstream swirler support plate 313 having circumferentially spaced apart openings 313*a* in registry with the doors 342 are welded, brazed or otherwise fastened to an upstream annular support member 319. The upstream support member 319, in turn, is fastened on the upstream combustor wall 330 via annular member 331. The swirler support member 319 includes a central opening 319*a* to allow air flow to the doors 342.

The variable area swirler 316 functions in the manner described hereinabove for the embodiment of FIGS. 1-2 to provide predetermined air flow rate and air swirl angle for discharge from air swirler shroud 320 to the combustor chamber 318 in response to increases (or decreases) in air pressure differential upstream and downstream thereof (P1 vs. P2) resulting from increases (or decreases) in fuel flow through the nozzle 314.

The fuel nozzle 314 comprises a tubular airblast fuel injector 317 having a central inner air chamber 321 and inner air discharge lip 321*a* and an outer annular fuel chamber 323 and fuel discharge lip 323*a* for discharging fuel to the combustor chamber 318. In the arrangement shown in FIG. 5, the fuel stream discharged from the fuel discharge lip 323*a* is subjected to mixing and atomization by inner air flow from inner air discharge lip 321*a* and outer air flow from the swirler 316.

The fuel injector 317 includes an extension 322 brazed or otherwise affixed to a distensible fuel manifold 341 that receives fuel from a supply pipe 347 (shown broken away for clarity). The distensible manifold 341 is of the type described in the Halvorsen U.S. Pat. No. 3,827,638 and includes a pintle 343 brazed or otherwise affixed thereon for cooperation with a valve seat 345 formed on the extension 322 to meter fuel flow to the injector 317 in response to fuel pressure in the manifold 341 for discharge from the fuel discharge lip 323*a* and mixing and atomization by the aforementioned inner and outer air flows. The fuel supply pipe 347 is mounted on duct wall 349.

From the embodiments of the invention described hereinabove, it is apparent that the self-actuating, variable area/geometry air swirlers 16, 216(216'), 316 are free of mechanical linkages and free of sliding or other contact between swirler components which heretofore are known to be prone to binding and swirler malfunction in service in the hot environment of the gas turbine engine combustor inlet. The invention provides an elegantly simple self-actuating air swirler that is capable of providing predetermined air flow rates and air swirl angles in response to increases (or decreases) in fuel flow through the associated fuel nozzle without the need for the complex mechanical arrangements heretofore used.

As is apparent, one or more air swirlers of the invention ca be used in association with the fuel nozzle of the combustor to provide a wide variety of air flow rates and air swirl angles as needed for a particular combustor application.

While certain preferred embodiments of the invention have been described hereinabove, those skilled in the art will recognize that various modifications and changes can be made therein for practicing the invention as defined in the following claims.

We claim:

1. In combination, a gas turbine engine combustor having an inlet, a fuel nozzle cooperatively disposed relative to the inlet for supplying fuel to the combustor and a variable area air swirler cooperatively disposed relative to the inlet for admitting air to the combustor from a compressor, said swirler comprising a swirler member having a plurality of air control doors so formed therein as to have a side integrally and resiliently pivotally connected to said swirler member to define a door hinge axis such that said doors are progressively canted relative to said swirler member for providing a predetermined air flow rate and air swirl angle in response to variations in air pressure differential across the swirler resulting from variations in fuel flow through the nozzle.

2. The combination of claim 1 wherein each air control door is defined by an incision in the swirler member.

3. The combination of claim 1 wherein said air control doors each are so formed as to have an elongated side integrally and resiliently pivotally connected to the swirler member to define the door hinge axis.

4. The combination of claim 1 wherein the swirler member comprises a tubular member having a longitudinal axis generally parallel with a longitudinal axis of the combustor inlet, said air control doors being so formed in said tubular member as to be spaced apart around the longitudinal axis thereof and as to have the door hinge axis of each door generally parallel with the longitudinal axis of the inlet.

5. The combination of claim 1 wherein the swirler member comprises spring temper metal.

6. The combination of claim 1 wherein the swirler member and the air control doors formed thereon have a wall thickness of about 0.001 inch to about 0.010 inch.

7. The combination of claim 1 wherein the nozzle is an airblast nozzle having an air discharge opening disposed axially inwardly of a fuel discharge opening.

8. The combination of claim 1 wherein the nozzle is a pressure atomizing nozzle.

9. The combination of claim 1 wherein the nozzle is a hybrid airblast/pressure atomizing nozzle.

10. The combination of claim 7 wherein said airblast nozzle comprises an airblast fuel injector mounted on a distensible fuel manifold, said manifold having a pintle that cooperates with a valve seat on the injector to vary fuel flow through the injector in response to changes in manifold fuel pressure.

11. The combination of claim 1 including an air swirler shroud so disposed relative to the swirler as to receive said air therefrom and discharge said air into the combustor.

12. In combination, a gas turbine engine combustor having an upstream inlet with a longitudinal axis, a fuel nozzle cooperatively disposed relative to the inlet for supplying fuel to the combustor and a variable area air swirler cooperatively disposed relative to the inlet for admitting air to the combustor from an upstream compressor, said swirler comprising a spring temper swirler member having a plurality of air control doors disposed about said longitudinal axis and so formed in said support member as to have a side integrally and resiliently pivotally connected thereto to define a door hinge axis such that said doors are progressively canted in an open direction or in a closed direction for providing a predetermined air flow rate and air swirl angle in response to respective increases or decreases in air pressure differential across the swirler resulting from respective increases or decreases in fuel flow through the nozzle.

13. The combination of claim 12 wherein each air control door is defined by an incision in the swirler member.

14. The combination of claim 12 wherein said air control doors each are so formed as to have an elongated side integrally and resiliently pivotally connected to the swirler member to define the door hinge axis.

15. The combination of claim 13 wherein the swirler member comprises a tubular member having a longitudinal axis generally parallel with a longitudinal axis of the combustor inlet, said air control doors being so formed in said tubular member as to be spaced apart around the longitudinal axis thereof and as to have the door hinge axis of each door generally parallel with the longitudinal axis of the inlet.

16. The combination of claim 12 wherein the swirler member comprises an annular plate having a longitudinal axis generally parallel with a longitudinal axis of the combustor inlet, said air control doors being so formed in said plate as to be spaced apart around said longitudinal axis of said inlet and as to have the door hinge axis transverse to the longitudinal axis of the inlet.

17. The combination of claim 12 wherein the swirler member comprises spring temper metal.

18. The combination of claim 12 wherein the swirler member and the air control doors formed thereon have a wall thickness of about 0.001 inch to about 0.010 inch.

19. The combination of claim 12 wherein the nozzle is an airblast nozzle having an air discharge opening disposed axially inwardly of a fuel discharge opening.

20. The combination of claim 19 wherein said airblast nozzle comprises an airblast fuel injector mounted on a distensible fuel manifold, said manifold having a pintle that cooperates with a valve seat on the injector to vary fuel flow through the injector in response to changes in manifold fuel pressure.

21. In combination, a gas turbine engine combustor having an inlet, a fuel nozzle cooperatively disposed relative to the inlet for supplying fuel to the combustor and a variable area air swirler cooperatively disposed relative to the inlet for admitting air to the combustor from a compressor, said swirler comprising an annular swirler plate member having a longitudinal axis generally parallel with a longitudinal axis of the combustor inlet and having plurality of air control doors so formed therein as to have a side integrally and resiliently pivotally connected to said swirler member to define a door hinge axis such that said doors are progressively canted relative to said swirler member for providing a predetermined air flow rate and air swirl angle in response to variations in air pressure differential across the swirler resulting from variations in fuel flow through the nozzle, said air control doors being so formed on said swirler plate member as to be spaced apart around the longitudinal axis of said inlet and as to have the respective door hinge axis oriented transverse to the longitudinal axis of said inlet.

* * * * *